US008981262B2

(12) United States Patent
Henry et al.

(10) Patent No.: US 8,981,262 B2
(45) Date of Patent: Mar. 17, 2015

(54) STEAMER DEVICE

(75) Inventors: Karlheinz Henry, Sinzheim (DE); Yves Lebrun, Eschau (FR)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 53 days.

(21) Appl. No.: 13/382,350

(22) PCT Filed: Jun. 30, 2010

(86) PCT No.: PCT/EP2010/059248

§ 371 (c)(1),
(2), (4) Date: Jan. 5, 2012

(87) PCT Pub. No.: WO2011/003781

PCT Pub. Date: Jan. 13, 2011

(65) Prior Publication Data

US 2012/0111849 A1 May 10, 2012

(30) Foreign Application Priority Data

Jul. 9, 2009 (EP) ..... 09290557

(51) Int. Cl.
*A21B 1/00* (2006.01)
*F24C 14/00* (2006.01)

(52) U.S. Cl.
CPC ..... *F24C 14/005* (2013.01)
USPC ..... 219/401

(58) Field of Classification Search
USPC ..... 219/400–402, 391, 407; 392/394, 392/397–8; 126/20, 369, 369.1; 134/19, 134/22.1
See application file for complete search history.

(56) References Cited

U.S. PATENT DOCUMENTS

| | | | | |
|---|---|---|---|---|
| 3,425,405 | A | 2/1969 | Dills | |
| 3,529,582 | A | 9/1970 | Hurko et al. | |
| 3,877,972 | A | 4/1975 | Arnold | |
| 5,407,700 | A | 4/1995 | Man et al. | |
| 5,480,493 | A * | 1/1996 | Harry, Jr. | 134/4 |
| 5,499,577 | A | 3/1996 | Tommasini | |
| 5,676,870 | A | 10/1997 | Wassman et al. | |
| 6,054,227 | A | 4/2000 | Greenberg et al. | |
| 6,131,559 | A | 10/2000 | Norris et al. | |
| 6,410,890 | B1 | 6/2002 | Kohlstrung | |

(Continued)

FOREIGN PATENT DOCUMENTS

| | | |
|---|---|---|
| DE | 2842771 A1 | 4/1980 |
| DE | 19939673 A1 | 5/2001 |

(Continued)

OTHER PUBLICATIONS

International Search Report PCT/EP2010/059248.

(Continued)

*Primary Examiner* — Dana Ross
*Assistant Examiner* — Renee L Miller
(74) *Attorney, Agent, or Firm* — James E. Howard; Andre Pallapies

(57) ABSTRACT

A steam cooking appliance apparatus includes a muffle unit which at least partially bounds a cooking chamber. The muffle unit has a muffle element which forms a boundary surface of the cooking chamber in at least one operating state. The boundary surface of the cooking chamber has a cooking fat adhesion which is lower than a cooking fat adhesion of stainless steel. At least one cleaning unit is provided for cleaning at least part of the muffle unit.

17 Claims, 3 Drawing Sheets

(56) References Cited

U.S. PATENT DOCUMENTS

| | | | | |
|---|---|---|---|---|
| 6,478,034 | B1 | 11/2002 | Durth et al. | |
| 6,545,251 | B2 | 4/2003 | Allera et al. | |
| 6,626,190 | B2 | 9/2003 | Durth et al. | |
| 6,772,751 | B2 | 8/2004 | Deuringer et al. | |
| 6,909,071 | B2 * | 6/2005 | Shozo | 219/401 |
| 6,986,817 | B2 | 1/2006 | Riefenstein et al. | |
| 7,005,396 | B2 | 2/2006 | Espargilliere et al. | |
| 7,005,613 | B1 | 2/2006 | Spohn | |
| 7,044,122 | B2 | 5/2006 | Personnettaz et al. | |
| 7,677,239 | B2 | 3/2010 | De Miranda Grieco | |
| 7,695,831 | B2 | 4/2010 | Shon et al. | |
| 7,739,948 | B2 | 6/2010 | Backus et al. | |
| 8,042,533 | B2 | 10/2011 | Dobie et al. | |
| 8,151,697 | B2 | 4/2012 | Valentine et al. | |
| 8,193,470 | B1 | 6/2012 | Harlamert et al. | |
| 8,334,482 | B2 | 12/2012 | Nam et al. | |
| 8,373,098 | B2 | 2/2013 | Johnson | |
| 2001/0011549 | A1 | 8/2001 | Durth et al. | |
| 2006/0011607 | A1 * | 1/2006 | Cho et al. | 219/401 |
| 2008/0223357 | A1 | 9/2008 | Bartelick et al. | |
| 2010/0072188 | A1 | 3/2010 | Lee et al. | |
| 2010/0264126 | A1 | 10/2010 | Baek et al. | |
| 2010/0282732 | A1 | 11/2010 | Fich Pedersen | |
| 2011/0011423 | A1 | 1/2011 | Baek et al. | |
| 2011/0111239 | A1 | 5/2011 | Dandekar et al. | |
| 2011/0139141 | A1 | 6/2011 | Shaffer et al. | |
| 2011/0266271 | A1 | 11/2011 | Boyer et al. | |
| 2012/0118321 | A1 | 5/2012 | Neplenbroek et al. | |
| 2012/0145696 | A1 | 6/2012 | Johnson | |

FOREIGN PATENT DOCUMENTS

| | | | | |
|---|---|---|---|---|
| EP | 0892220 | A1 | * | 1/1999 |
| EP | 1852658 | A2 | | 11/2007 |
| JP | 58033031 | A | | 2/1983 |
| JP | 2005238030 | A | * | 9/2005 |
| JP | 2008226608 | A | | 9/2008 |
| KR | WO2008/044844 | | * | 4/2008 |

OTHER PUBLICATIONS

Ferro, Reinvent self-cleaning ovens, AquaRealEase (sell sheet), www.ferro.com, Feb. 2013.

* cited by examiner

STEAMER DEVICE

BACKGROUND OF THE INVENTION

The invention is based on a steam cooking appliance apparatus.

A steam cooking appliance apparatus having a muffle unit bounding a cooking chamber is known from the publication DE 28 42 771 C2. The steam cooking appliance apparatus has a cleaning unit, by means of which a fluid cleaning agent can be introduced into the cooking chamber.

A cooking appliance having a cleaning apparatus is known from the publication DE 199 61 835 C2. During a cleaning process the cleaning apparatus introduces fluid into a cooking chamber of the cooking appliance.

BRIEF SUMMARY OF THE INVENTION

The object of the invention is in particular to provide a generic apparatus with improved attributes in respect of simple cleanability. According to the invention the object is achieved by the features of claim 15, while advantageous embodiments and developments of the invention will emerge from the subclaims and the independent claim.

The invention is based on a steam cooking appliance apparatus having a muffle unit at least partially bounding a cooking chamber, featuring a muffle element forming a cooking chamber boundary surface in at least one operating state, and having at least one cleaning unit, which is provided to clean at least part of the muffle unit.

It is proposed that the cooking chamber boundary surface has a lower cooking fat adhesion than stainless steel. A "cleaning unit" here refers in particular to a unit which in at least one operating state is functionally connected to at least one further component of the steam cooking appliance apparatus and is preferably fastened to this and which is provided to clean at least one component of the steam cooking appliance apparatus. A "muffle element forming a cooking chamber boundary surface" here refers in particular to an element, which in at least one cooking process taking place in a cooking chamber forms a surface, which directly bounds the cooking chamber. The statement that the cooking chamber boundary surface has a "lower cooking fat adhesion than stainless steel" is intended in particular to mean that a deposit on the cooking chamber boundary surface deposited on the cooking chamber boundary surface during a heating process to heat an item to be cooked in the cooking chamber in the course of an overall heating time of the heating process can be detached with less force from the cooking chamber boundary surface than a deposit deposited on the cooking chamber boundary surface during the same heating process, if said surface were made of stainless steel. The item to be cooked here is formed in particular at least partially from animal and/or vegetable material, in particular from animal and/or vegetable fats and in particular from olive oil, which consists in particular of fatty acids bound to glycerine, 72 percent of the fatty acids being formed by oleic acid, 8 percent by linoleic acid, 12 percent by palmitic acid, 3 percent by stearic acid and 5 percent by palmitoleic acid. A "heating process to heat an item to be cooked" refers in particular to a process, in which the item to be cooked is heated at least partially to over 140° C. and preferably to over 180° C. and is preferably heated to said temperatures for at least fifty percent of the overall heating time of the heating process. An "overall heating time of the heating process" refers in particular to a time during which, in the performance of the heating process, heat generated by at least one heating element is supplied to the item to be cooked, the time preferably being ten minutes and even more preferably one hour. The fact that the first-mentioned deposit can be detached with "less force" than the second-mentioned deposit means in particular that when using the same tool, preferably a spatula, to detach the deposits, for a complete removal in each instance of every part of the deposits with a single hand movement in each instance, a smaller maximum force is required to detach the first-mentioned deposit than to detach the second-mentioned deposit. "Stainless steel" refers in particular to a stainless steel with the material number 1.4404 or 1.4301. Simple cleanability can be achieved with an inventive embodiment. In particular it is possible to detach deposits from the cooking chamber boundary surface with little force expenditure and in particular by means of an at least partially automated cleaning process, which can include in particular the spraying of water and/or cleaning fluid onto the cooking chamber boundary surface.

It is also proposed that at least part of the muffle unit is configured with two layers at least. The fact that a part of the muffle unit is "configured with two layers" means in particular that the part has at least two layers that rest at least partially against one another and—in at least a front view, looking at one of the layers at least—at least partially one on top of the other. This allows an economical construction to be achieved. In particular it is possible for the cooking chamber boundary surface to be formed economically by a coating.

The muffle element is preferably formed at least partially from a polymer and/or enamel and/or silicon. The muffle element is preferably formed at least partially from polytetrafluoroethylene. In particular the muffle element is formed at least partially from the plastic known as Teflon, which is largely formed from the material polytetrafluoroethylene. This allows a particularly low cooking fat adhesion to be achieved. It is possible in particular to prevent the muffle rusting.

The steam cooking appliance apparatus advantageously has at least one application unit, which is provided to apply the muffle element in a free-flowing state to at least part of the muffle unit. "Provided" here means in particular specifically designed and/or specifically equipped. A substance in a "free-flowing" state refers in particular to a substance in a state which has sub-regions that move relative to one another when the substance is distributed. An "application" of the muffle element to part of the muffle unit refers in particular to the bringing into contact of the muffle element with the part and subsequent fastening and/or adhesion of the muffle element to the part. This allows particularly thorough cleanability to be achieved. In particular it is possible for dirt adhering to the muffle element to be removed together with the muffle element in a simple manner after a cooking process. The muffle element is preferably formed at least partially by a powder, allowing the muffle element to be detached easily. The muffle element is advantageously formed by at least one substance, which is fluid in the free-flowing state, thereby allowing it to be applied particularly easily.

The steam cooking appliance apparatus preferably has at least one substance introduction unit, which is provided to introduce at least one substance into the cooking chamber. This allows user-friendly cleanability to be achieved. In particular a muffle unit can be cleaned with the aid of a jet of fluid and/or steam.

It is also proposed that the substance introduction unit has at least one line opening into the cooking chamber. A "line" refers in particular to an element provided to convey fluids and/or gases from an initial region of the element through a hollow space in the element to a final region of the element, with the length of a path traveled by a substance conveyed by the element deviating by less than eighty percent, preferably by less than forty percent and particularly preferably by less than ten percent from a maximum lengthways extension of the element. This allows flexible introduction of a substance into the cooking chamber. In particular with a simple construction a substance can be introduced into the cooking chamber through openings disposed on a number of sides of the cooking chamber.

The steam cooking appliance apparatus preferably has at least one arm unit, which features at least part of the line and through which the substance introduction unit introduces steam into the cooking chamber in at least one operating process. An "arm unit" refers in particular to a unit, which features at least one arm, which has a maximum lengthways extension, which is at least three times, preferably at least five times and particularly preferably at least ten times as long as a maximum widthways extension and a maximum height extension of the unit. This allows efficient introduction of the steam and in particular even distribution of the steam in the cooking chamber to be achieved.

The muffle unit advantageously features at least one accessory holding region, which is separate from the cooking chamber and which is provided at least partially to hold at least one cleaning unit provided for removal by a user and/or at least one coating unit and/or at least one fluid introduction unit. An "accessory holding region" refers in particular to a holding region provided to be free of items to be cooked in any operating state and in particular during any operational cooking process. A "coating unit" refers in particular to a unit, by means of which a surface, in particular of a cooking chamber, can be coated. This allows a user-friendly construction to be achieved.

It is also proposed that the steam cooking appliance apparatus should feature at least one care agent connector, which is provided to introduce care agent from a care agent supply that is independent of the appliance. A "care agent supply that is independent of the appliance" refers in particular to a line unit for transporting care agent which is configured as separate from the steam cooking appliance apparatus and preferably separate from a household appliance that features the steam cooking appliance apparatus. A "care agent" refers in particular to a substance for caring for and preferably cleaning surfaces. This ensures that it is convenient to use.

A steam cooking appliance apparatus having at least one cooking steam introduction unit and at least one cleaning steam introduction unit, which is configured in part at least as separate from the cooking steam introduction unit, is also proposed. The fact that the cleaning steam introduction unit is configured "in part at least as separate" from the cooking steam introduction unit means in particular that the cooking steam introduction unit is free of at least one steam supply line, which is part of the cleaning steam introduction unit. A "cooking steam introduction unit" refers in particular to a steam introduction unit, which is mainly provided to introduce steam for cooking purposes. A "cleaning steam introduction unit" refers in particular to a steam introduction unit, which is mainly provided to introduce steam for cleaning a cooking chamber boundary surface and which preferably sprays steam directly onto the cooking chamber boundary surface when it is introduced into the cooking chamber. This allows simple cleanability to be achieved.

A household appliance having a steam cooking appliance apparatus with which simple cleanability can be achieved is also proposed.

A steam cooking appliance cleaning method, in particular for cleaning the steam cooking appliance apparatus, is also proposed, in which a fluid is injected and/or sprayed onto at least one cooking chamber boundary surface, which has a lower cooking fat adhesion than stainless steel. This allows simple cleanability to be achieved.

A muffle element is preferably applied to at least one muffle component before the fluid is injected and/or sprayed on. This allows particularly thorough cleanability to be achieved. In particular it is possible for dirt adhering to the muffle element to be removed together with the muffle element in a simple manner after a cooking process.

BRIEF DESCRIPTION OF THE DRAWINGS

Further advantages will emerge from the description of the drawings which follows. The drawing shows exemplary embodiments of the invention. The drawing, description and claims contain numerous features in combination. The person skilled in the art will expediently also consider the features individually and combine them in useful further combinations.

DETAILED DESCRIPTION OF EXEMPLARY EMBODIMENTS OF THE PRESENT INVENTION

Figure 1:
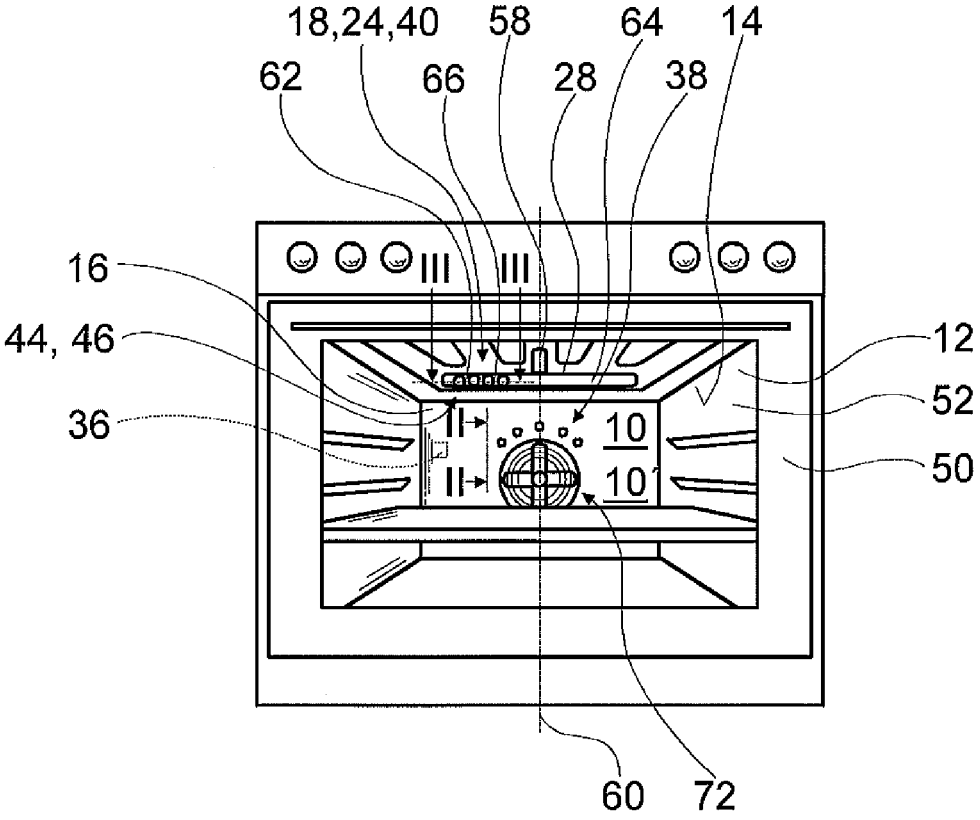
FIG. 1 shows a front view of a household appliance configured as a steam oven with an inventive steam cooking appliance apparatus.

FIG. 1 shows a steam oven having a household appliance apparatus, which is configured as an inventive steam cooking appliance apparatus. The steam cooking appliance apparatus features a muffle unit 12, which comprises a muffle element 16. The muffle unit 12 forms a useful space 10 of the steam cooking appliance apparatus configured as a cooking chamber 10', with the muffle element 16 forming a cooking chamber boundary surface 14, which directly bounds the cooking chamber 10'. The steam cooking appliance apparatus further features a cleaning unit 18, which is provided to clean the cooking chamber boundary surface 14 and an inner surface of a door 50 of the steam cooking appliance apparatus, which directly bounds the cooking chamber 10' when the door 50 is closed.

Figure 2:
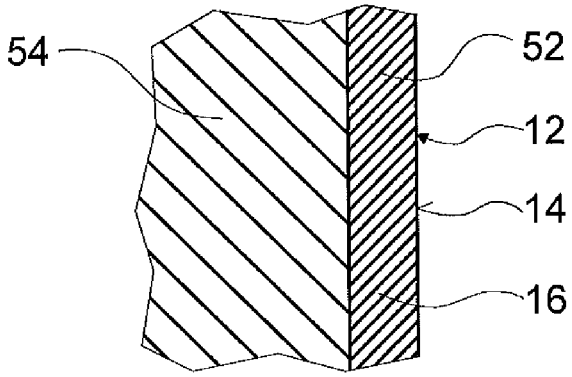
FIG. 2 shows a section through a muffle unit of the steam cooking appliance apparatus.

The muffle element 16 is configured as a Teflon layer 52 (FIG. 2), with the result that the cooking chamber boundary surface 14 has lower cooking fat adhesion than stainless steel. The Teflon layer 52 is disposed on a layer 54 of the muffle unit 12 formed from stainless steel.

Figure 3:
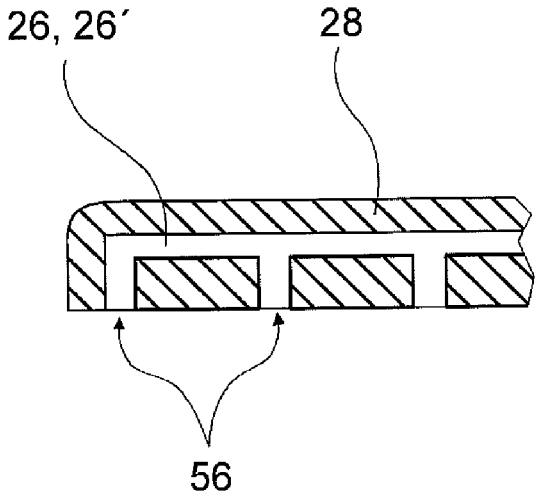
FIG. 3 shows part of a section through an arm unit of the steam cooking appliance apparatus.

A substance supply unit 44 of the steam cooking appliance apparatus features the cleaning unit 18, which likewise forms a substance introduction unit 24 for introducing substances into the cooking chamber 10'. The substance introduction unit 24 is formed by an arm unit 28, which is supported rotatably by a bearing unit 58 and features the line 26 configured as a fluid line 26', which opens at opening points 56 into the cooking chamber 10' (FIGS. 1 and 3). The opening points 56 can in principle also be formed by nozzles. During operating processes the substance introduction unit 24 conducts steam and/or fluid, which in particular comprises a cleaning agent, in particular featuring rinse aids and/or tensides, through the line 26 and the opening points 56 into the cooking chamber 10'. The steam and fluid can be introduced into the cooking chamber 10' at a high pressure. The introduction of the steam is initiated by a steam supply unit 46 of the substance supply unit 44, of which the substance introduction unit 24 is a part. Because the arm unit 28 only features opening points 56 in one side region 66 respectively on each of the two arm segments 62, 64 and the arm unit 28 is supported rotatably about an axis 60 running vertically in an operating state, the arm unit 28 rotates about the axis 60 when the fluid or steam exits into the cooking chamber 10'. This means that an entire cooking chamber boundary surface 14 is sprayed evenly with the fluid or steam. Spraying with the fluid detaches food residues present on the Teflon layer 52, these being formed predominantly by fat. The steam supply unit 46 forms a cleaning steam introduction unit 40 of the steam cooking appliance apparatus. Cleaning by means of the steam supply unit 46 preferably takes place in that before spraying with the fluid, steam is introduced through the arm unit 28 into the cooking chamber 10', thereby softening the food residues and making them easy to detach from the Teflon layer 52. When the Teflon layer 52 has been cleaned, it can be dried by a standard heating system 72 of the steam cooking appliance apparatus. The standard heating system 72 is configured as a circulating heater. The standard heating system 72 also allows cooking processes to be operated in the cooking chamber 10', in which there is no need for steam.

In addition to the cleaning steam introduction unit 40 the steam cooking appliance apparatus also features a cooking steam introduction unit 38 (FIG. 1), which introduces steam into the cooking chamber 10' in such a manner that its inflow direction is directed towards a center point of the cooking chamber 10', with the result that items to be cooked come into contact with the steam shortly after the steam has entered the cooking chamber 10'.

The substance introduction unit 44 also features a care agent connector 36, which is disposed on a rear face of the household appliance and which is connected to a line configured as separate from the household appliance when the household appliance is fitted, said line being provided to convey care agent through the care agent connector 36 into the household appliance.

Figure 4:
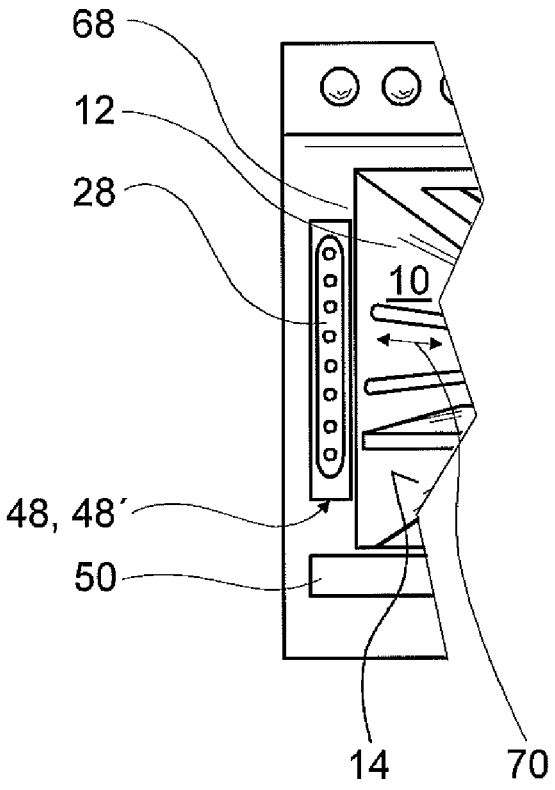
FIG. 4 shows part of a front view of the steam cooking appliance apparatus, with a door of the steam cooking appliance open and the arm unit in a stowed state.

The muffle unit 12 also features an accessory holding region 48, in which the arm unit 28 is held in its entirety in at least one operating state of the household appliance apparatus (FIG. 4). The accessory holding region 48 is formed by a depression 48' in a muffle flange 68 of the muffle unit 12. The depression 48' extends from a surface of the muffle flange 68, against which a sealing unit (not shown) of the household appliance apparatus rests when the door 50 is closed, in a depthways extension direction of the cooking chamber 10'. The muffle unit 12 also features a fastening means (not shown), to which the arm unit 28 can be fastened without tools.

Water can be supplied to the substance supply unit 44 through a connector to a water network or water tank, with the substance supply unit 44 in the second instance featuring a pump to produce a high pressure. The steam cooking appliance apparatus also features a collection system (not shown) to collect fluids.

Figure 5:
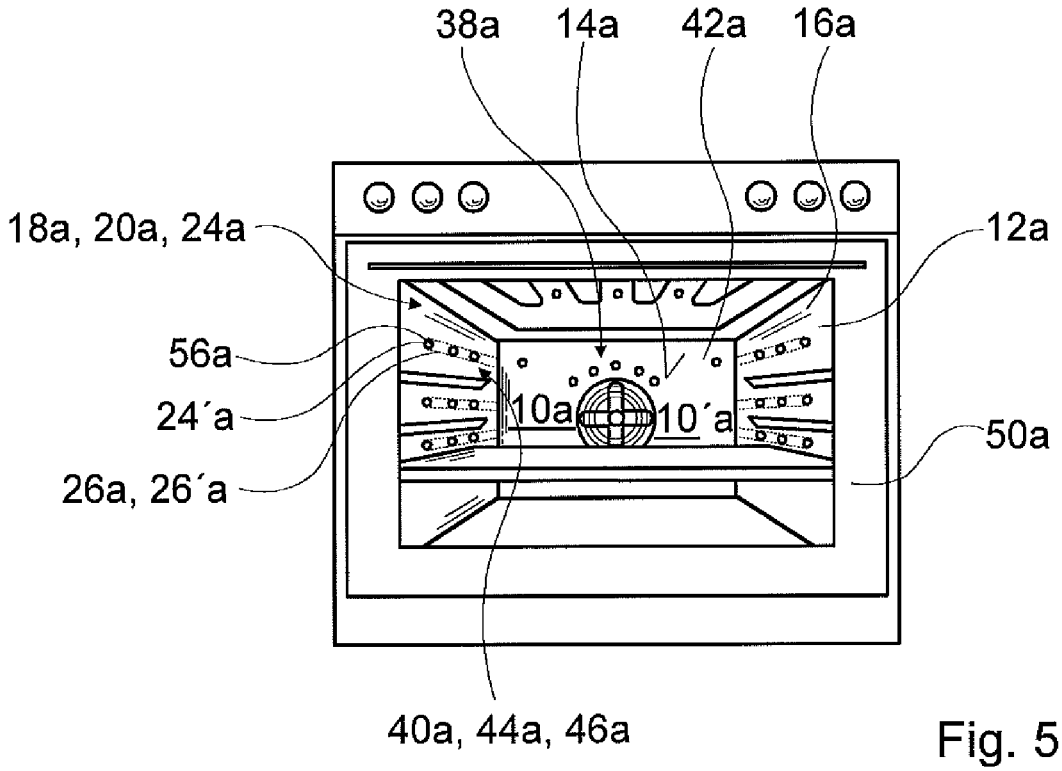
FIG. 5 shows an alternative exemplary embodiment of a steam cooking appliance apparatus.

FIG. 5 shows an alternative exemplary embodiment. Essentially identical components, features and functions are basically shown with the same reference characters. To differentiate between the exemplary embodiments however the letter "a" is appended to the reference character of the exemplary embodiment in FIG. 5. The description which follows is essentially limited to the differences in relation to the exemplary embodiment in FIGS. 1 to 4, it being possible to refer to the description of the exemplary embodiment in FIGS. 1 to 4 in respect of identical components, features and functions.

FIG. 5 shows an alternative exemplary embodiment of a steam cooking appliance apparatus having a substance introduction unit 24*a*, which is fastened to a muffle unit 12*a* of the steam cooking appliance apparatus and which is formed by nozzles 24'*a*. In an operational state a muffle component 42*a* made of stainless steel directly bounds a cooking chamber 10'*a* of the steam cooking appliance apparatus. In preparation for a cooking process silicon can be applied to the muffle component 42*a* by means of the substance introduction unit 24*a*, so that the silicon forms a muffle element 16*a* of the muffle unit 12*a*, forming a cooking chamber boundary surface 14*a*. After a cooking process a fluid is injected into the cooking chamber 10' by means of the substance introduction unit 24*a*, washing the silicon from the muffle component. In a certain operating mode the muffle element 16*a*, which is introduced into the cooking chamber by the substance introduction unit 24*a*, can also be formed by powder. An entire surface of the steam cooking appliance apparatus, which bounds the cooking chamber 10'*a*, can be flushed with the aid of the substance introduction unit 24*a*.

| Reference characters | |
|---|---|
| 10 | Useful space |
| 10' | Cooking chamber |
| 12 | Muffle unit |
| 14 | Cooking chamber boundary surface |
| 16 | Muffle element |
| 18 | Cleaning unit |
| 20 | Application unit |
| 24 | Substance introduction unit |
| 24' | Nozzle |
| 26 | Line |
| 26' | Fluid line |
| 28 | Arm unit |
| 36 | Care agent connector |
| 38 | Cooking steam introduction unit |
| 40 | Cleaning steam introduction unit |
| 42 | Muffle component |
| 44 | Substance supply unit |
| 46 | Steam supply unit |
| 48 | Accessory holding region |
| 48' | Depression |
| 50 | Door |
| 52 | Teflon layer |
| 54 | Layer |
| 56 | Opening point |
| 58 | Bearing unit |
| 60 | Axis |
| 62 | Arm segment |
| 64 | Arm segment |
| 66 | Side region |
| 68 | Muffle flange |
| 70 | Depthways extension direction |
| 72 | Standard heating system |

The invention claimed is:

1. A steam cooking appliance apparatus, comprising:

a muffle unit at least partially bounding a cooking chamber, the muffle unit having a muffle element having a cooking fat adhesion which is lower than a cooking fat adhesion of stainless steel;

a substance introduction unit for providing the muffle element to the muffle unit; and at least one cleaning unit for cleaning at least part of the muffle unit, wherein the muffle element is a powder.

2. The steam cooking appliance apparatus of claim 1, wherein the muffle unit has at least one part which is configured with at least two layers.

3. The steam cooking appliance apparatus of claim 1, wherein the substance introduction unit includes at least one line, which opens into the cooking chamber.

4. The steam cooking appliance apparatus of claim 3, further comprising at least one arm unit which includes at least part of the line and through which the substance introduction unit introduces steam into the cooking chamber in at least one operating process.

5. The steam cooking appliance apparatus of claim 1, wherein the cleaning unit is constructed for removal by a user, the muffle unit including at least one accessory holding region, which is separate from the cooking chamber and which is provided at least partially to hold the cleaning unit.

6. The steam cooking appliance apparatus of claim 1, further comprising at least one care agent connector, which is provided to introduce care agent from a care agent supply that is independent of the appliance.

7. The steam cooking appliance apparatus of claim 1, further comprising at least one cooking steam introduction unit to introduce steam into the cooking chamber to perform a cooking operation, wherein the cleaning unit is a cleaning steam introduction unit which is configured at least in part separate from the cooking steam introduction unit.

8. A household appliance, comprising:

a steam cooking appliance apparatus which includes a muffle unit at least partially bounding a cooking chamber, the muffle unit having a muffle element having a cooking fat adhesion which is lower than a cooking fat adhesion of stainless steel;

a substance introduction unit provided to apply the muffle element; and at least one cleaning unit, provided to clean at least part of the muffle unit, wherein the muffle element is a powder.

9. The household appliance of claim 8, wherein the muffle unit has at least one part which is configured with at least two layers.

10. The household appliance of claim 8, wherein the substance introduction unit includes at least one line, which opens into the cooking chamber.

11. The household appliance of claim 10, further comprising at least one arm unit which includes at least part of the line and through which the substance introduction unit introduces steam into the cooking chamber in at least one operating process.

12. The household appliance of claim 8, wherein the cleaning unit is constructed for removal by a user, the muffle unit including at least one accessory holding region, which is separate from the cooking chamber and which is provided at least partially to hold the cleaning unit.

13. The household appliance of claim 8, further comprising at least one care agent connector, which is provided to introduce care agent from a care agent supply that is independent of the appliance.

14. The household appliance of claim 8, further comprising at least one cooking steam introduction unit to introduce steam into the cooking chamber to perform a cooking operation, wherein the cleaning unit is a cleaning steam introduction unit which is configured at least in part separate from the cooking steam introduction unit.

15. A method for cleaning a steam cooking appliance having a muffle unit at least partially bounding a cooking chamber, said method comprising:

applying a muffle element having a cooking fat adhesion which is lower than a cooking fat adhesion of stainless steel onto the muffle unit prior to performing a cooking operation; and applying a cleaning fluid onto the muffle unit after the cooking operation to remove the muffle element, wherein the muffle element is a powder.

16. The method of claim 15, wherein applying the muffle element comprises injecting the muffle element onto at least one boundary surface of the cooking chamber.

17. The method of claim 15, wherein applying the muffle element comprises spraying the muffle element onto the at least one boundary surface of the cooking chamber.

* * * * *